United States Patent [19]

Windsor, III

[11] Patent Number: 5,054,758

[45] Date of Patent: Oct. 8, 1991

[54] MULTI-PLY PAPER SEPARATOR

[75] Inventor: Bruce M. Windsor, III, Norfolk, Va.

[73] Assignee: The United States of America as represented by the Secretary of the Navy, Washington, D.C.

[21] Appl. No.: 443,619

[22] Filed: Nov. 30, 1989

[51] Int. Cl.[5] ..... B65H 41/00

[52] U.S. Cl. ..... 270/52.5

[58] Field of Search ..... 270/52, 52.5, 39

[56] References Cited

U.S. PATENT DOCUMENTS

| | | | |
|---|---|---|---|
| 2,265,466 | 12/1941 | Winter | 270/525 |
| 2,273,162 | 2/1942 | Willard | 270/52.5 |
| 2,275,475 | 3/1942 | Sherman | 270/52.5 |
| 2,280,224 | 4/1942 | Euth | 270/52.5 |
| 2,334,283 | 11/1943 | Pfeiffer | 270/52.5 |
| 2,425,105 | 8/1947 | Mabon | 270/52.5 |
| 3,188,080 | 6/1965 | Kelliher | 270/52.5 |
| 4,533,131 | 8/1985 | Burns | 270/52.5 |
| 4,577,789 | 3/1986 | Hoffmann | 270/52.5 |

FOREIGN PATENT DOCUMENTS

| | | | |
|---|---|---|---|
| 972439 | 10/1964 | United Kingdom | 270/52.5 |
| 1397816 | 6/1975 | United Kingdom | 270/52.5 |

*Primary Examiner*—Edward K. Look
*Assistant Examiner*—Therese M. Newholm
*Attorney, Agent, or Firm*—John D. Lewis; Kenneth E. Walden

[57] ABSTRACT

An apparatus for separating continuous multiple ply paper manifolds into individual leaves of continuous fan-folded webs of paper. The apparatus comprises a housing for supporting the various components, a plurality of wire separators 11, and a paper drive mechanism 14 for pulling webs of paper through the apparatus. The apparatus allows for efficient and rapid separation of the continuous manifold into individual webs without tearing or separating the individual web.

6 Claims, 3 Drawing Sheets

MULTI-PLY PAPER SEPARATOR

ORIGIN OF THE INVENTION

The invention described herein was made in the performance of official duties by an employee of the Department of the Navy and may be manufactured, used, licensed by or for the government for any governmental purposes without payment of any royalties thereon.

FIELD OF THE INVENTION

This invention relates to paper handling machines and more particularly to devices for handling a plurality of webs disposed in juxtaposed relationship and arranged in a fan-fold pack.

BACKGROUND OF THE INVENTION

With the present usage of continuous business forms such as computer printouts and the like which provide an original and layered multiple duplicate forms it becomes necessary to separate the original, the carbon sheets and the copy sheets. When making multiple copies using inscribing machines such as typewriters, teletype machines and computer printers, conventional procedure is to use continuous paper webs arranged in juxtaposed position having either carbon webs interleaved between sheets or using chemically treated paper on which copies can be made without carbon paper. These continuous webs of carbon paper and paper are forwarded through a suitable machine to produce as many copies of data as is provided in the adjacent paper webs. The webs are usually fed from a supply station where the paper is stored in stacks of multi-leaved fan-folded paper. Many times it is desirable to retain all of the webs in their adjacent relationship, and in a continuous web form when forwarding the same to a receiving station near the machine. Thereafter, the webs are separated manually so that the record produced on each of the webs could be forwarded to a separate destination, each web containing the first, second, etc. copy of the data as determined by the position of the web occupied in the pack of adjacent or juxtaposed webs. However, manual manipulation of continuous webs is a difficult procedure and it is desirable to have an apparatus capable of separating the various webs of a multiple copy pack. Also, manual separation is cumbersome, time consuming, and contact with the carbon soils the hands of the operator and the printed material. For large scale operations, elaborate, complex machines have been devised for automatically separating numerous layers of continuous forms. However, such machines are unsuitable for use in a small office due to cost and size constraints.

SUMMARY OF THE INVENTION

The invention comprises a spring-wire rod assembly having side brackets with attachment holes allowing the assembly to be mounted on the output end of a printer and positioning the spring-rod components so that the multi-ply paper is separated by the rod and directed to separate stacks. An object of this invention is to provide a multiply paper separator for decollating multiple layers of juxtaposed fan-fold webs of paper. Another object of the invention is to provide an apparatus for decollating a continuous web multiple copy fan-fold pack in a manner that the copies thereof are separated one from the other and returned to their fan-folded condition in separate stacks, and the carbon webs are separated from the paper webs, and returned to the fan-folded condition if desired. Yet another object of the invention is to provide a method for separating a plurality of continuous webs arranged into a fan fold pack so that each of the webs can be collected as an individual stack arranged in a fan-fold pack. Yet another object of the invention is to provide a method for separating a plurality of continuous webs arranged in juxtaposed relationship by directing the webs in different angles with respect to one another so that they will be moved towards separate collecting stations and thereby maintained in a separate condition. Still another object of the invention is to provide an assorting or separating apparatus for disassembling superposed interfolded strips of manifolding material which may be economically constructed and operated and which will be efficient and rapid in use, substantially automatic in action, and unlikely to get out of repair. A further object of the invention is to provide an improved system for distribution of multiple copy inscribed forms, whereby corresponding copies of successive sets of forms will be maintained in sequence. Still a further object of the invention is to provide and apparatus and method of operation whereby collectively interfolded strips of record and transfer material may be progressively separated and refolded into independent units. Still a further object of the invention is to economize time and to facilitate distribution of multiple copies of inscribed forms.

BRIEF DESCRIPTION OF THE DRAWINGS

These and other objects and advantages of this invention will become apparent along with the drawings when referenced from the following description wherein.

DETAILED DESCRIPTION OF THE INVENTION

Figure 1:
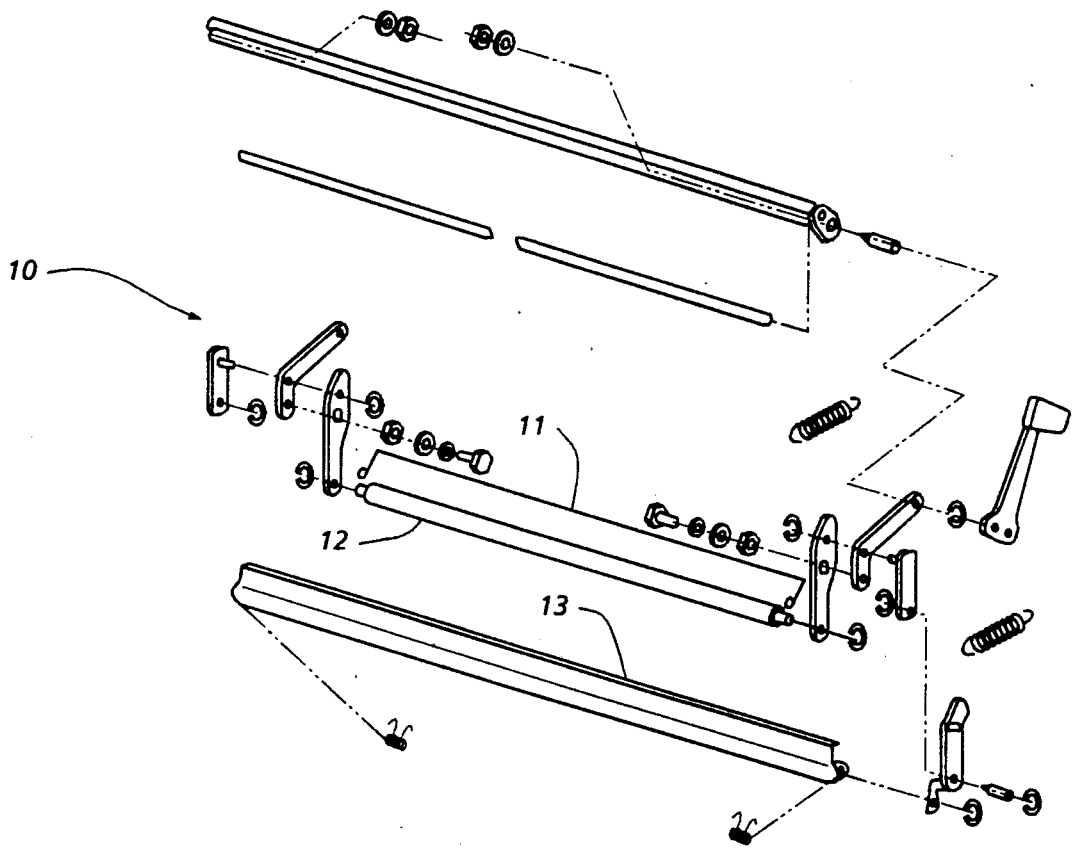
FIG. 1 depicts the installation of one element of the multi-ply paper separator as installed on a paper handling assembly of a representative printer.
Figure 3:
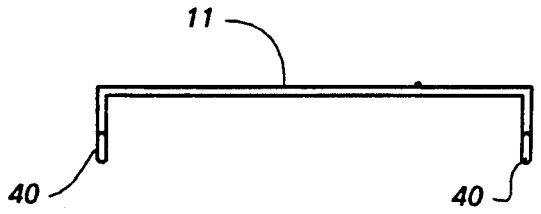
FIG. 3 is a front view of one element of the multi-ply paper separator.
Figure 2:
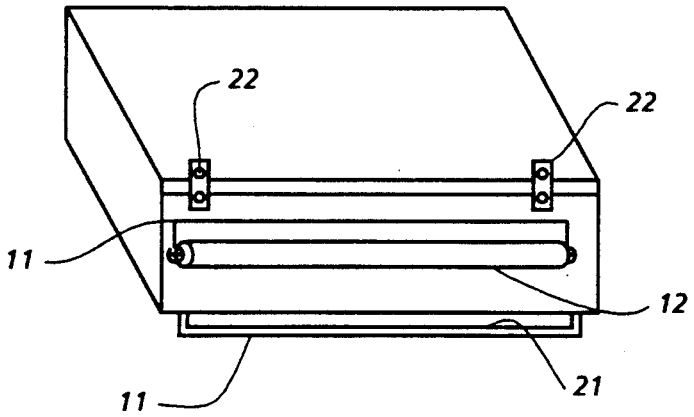
FIG. 2 is a diagram for a multi-ply paper separator installed on a typical printer
Figure 4:
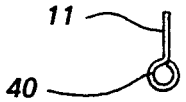
FIG. 4 is a side view of one element of the multi-ply paper separator.

Referring now to FIG. 1 the invention is shown in the diagram wherein there is provided within a paper handling assembly depicted by the reference numeral 10 comprising a separating element upon which paper webs are driven. In the preferred embodiment as shown, a plurality of separating elements 11 are disposed between the paper roller 12 and guide assembly 13 and before the tractor drive elements of the printer. Referring now to FIG. 2 in an alternate embodiment, separating elements 11 may be disposed across the input port 21 of the paper path, thus separating the paper before it is processed through the inscribing machine With the separator wires disposed across the input port 21 of the paper path, leaves of the paper are manually separated, fed around the separator elements so as to place a separator element 11 between each leaf. The various leaves are placed in their original alignment and fed in a normal manner through the printer to the tractor-assemblies 22. As the machine operates the tractor feed pulls the leaves of paper across the separator elements 11 thus separating the paper leaves one from another. When the paper begins to exit the printer each individual web may be directed along a path to position that particular web in a desired location. Alternately, the paper may be separated after being inscribed. As the paper exits the printer, leaves are fed around the separator elements 11 such that a separator element 11 is positioned between each leaf. The various leaves are then returned to their original alignment and fed in a normal manner into the tractor-feed 22. Tractor-feed 22 then pulls the paper through the printer and across the separator element 11. As the paper exits the printer each individual web or combination of adjacent webs may be directed along a path to a chosen storage location. (See FIG. 7). The separator elements, in both cases, are stiff wires which are securely attached to a fixed location in relation to the travel of the paper webs. In the case of the separator elements being positioned after the printing operation, they are normally attached to a roller. Referring now to FIG. 3 and FIG. 4 each separator element 11 comprises a length of wire bent at each end to form loops 40 which are soldered closed. The loops are installed on the roller 12 in such a manner that the roller 12 may freely rotate within the loops. As the tractor feed assembly 22 operates, leaves of paper are pulled in such a manner that a separator element 11 is disposed between each leaf causing separation of the various leaves, while allowing the leaves to advance in parallel planes in close proximity to each other. As the paper exits the printer, the several leaves may be guided to distinct locations as desired. The number of separator elements required is determined by on the number of leaves or webs in the paper manifold.

Figure 7:
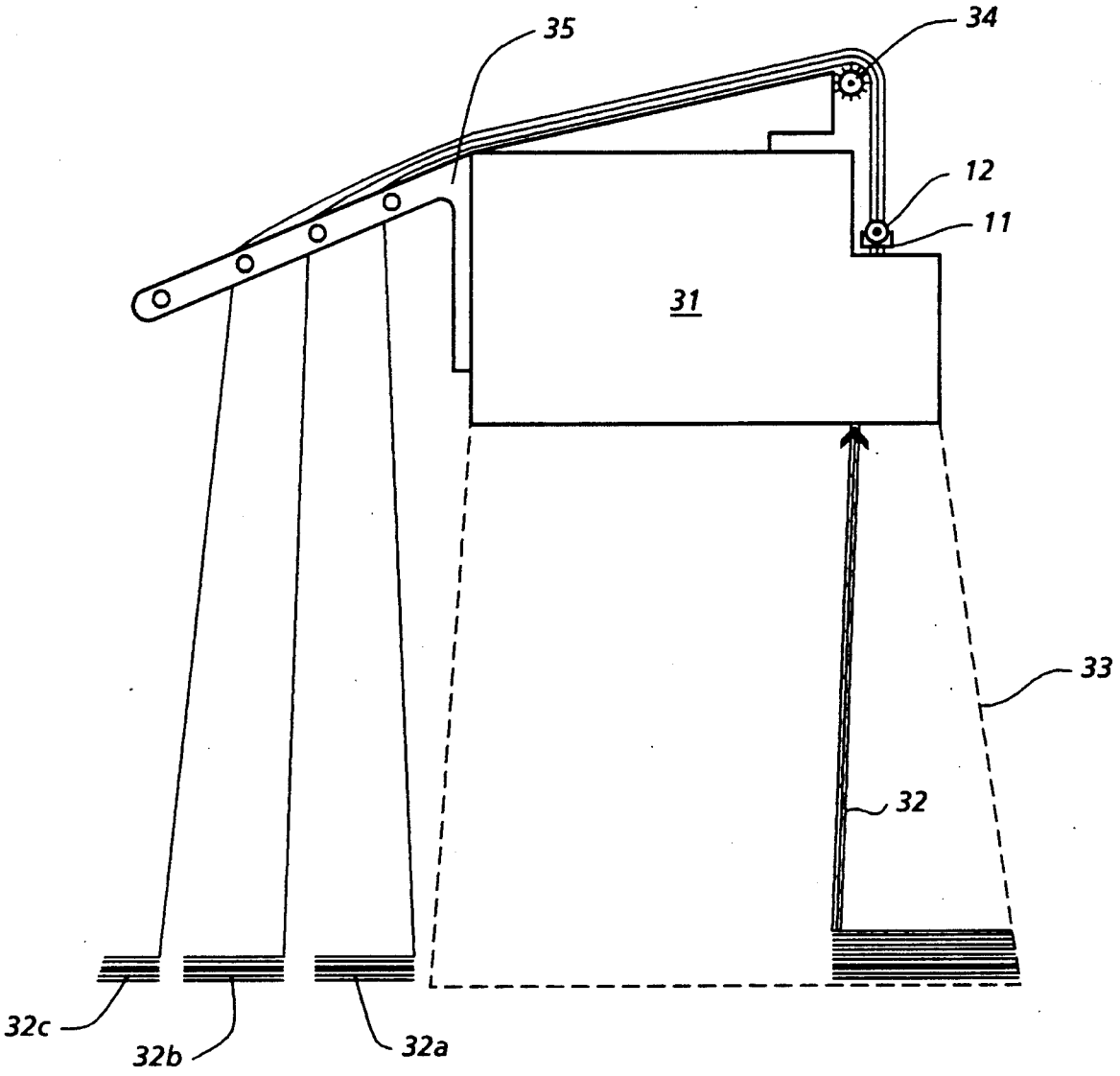
FIG. 7 illustrates applicant's invention installed on a tripartite paper printer.

Turning now to FIG. 7, an illustration is shown of a printer employing one embodiment of applicant's invention. Therein a printer 31 is shown mounted on a pedestal 33 containing a supply of multi-part paper 32. Paper 32 is pulled through printer 31 with a conventional tractor feed mechanism 34. As paper 32 exits the image forming section of printer 31 it passes over a roller 12 containing a dual separator element 11 which separates paper 31 into its three constituent parts. After the now separated paper 32 is propelled by tractor feed mechanism 34 it is fed to a guide 35 which guides the paper to three separated stacks 32*a*, 32*b* and 32*c* for distribution.

When the paper is fed from the bottom of the printer or when it is desired to separate the webs before printing, the paper separator elements are placed across the input port 21 of the paper path. The paper leaves are separated with a separator element 11 disposed between each web. The webs are the fed into the printer and into the tractor feed in the usual manner. As the tractor feed pulls the paper through the printer, each web is separated, one from the other, as it enters the printer by the separator elements 11 interspersed between the leaves. As the paper exits the printer each web may be directed to a specific location. There are many means of attaching the wire separator elements to the printer, two of which have already been described. Another embodiment uses bearings attached to the roller with the separator elements attached to the bearing housing, and the paper path being as before.

Figure 5:
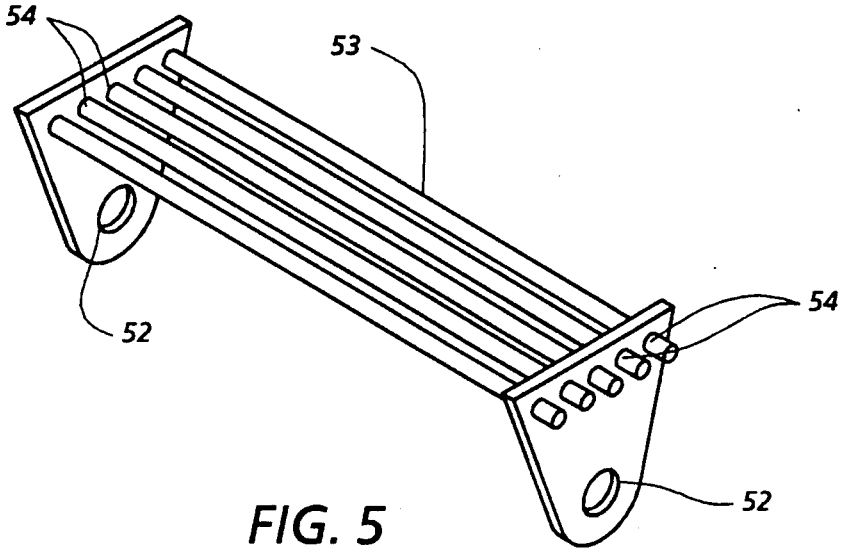
FIG. 5 depicts the installation of one multi-element configuration of the multi-ply paper separator as installed on a paper handling assembly of a representative printer.
Figure 6:
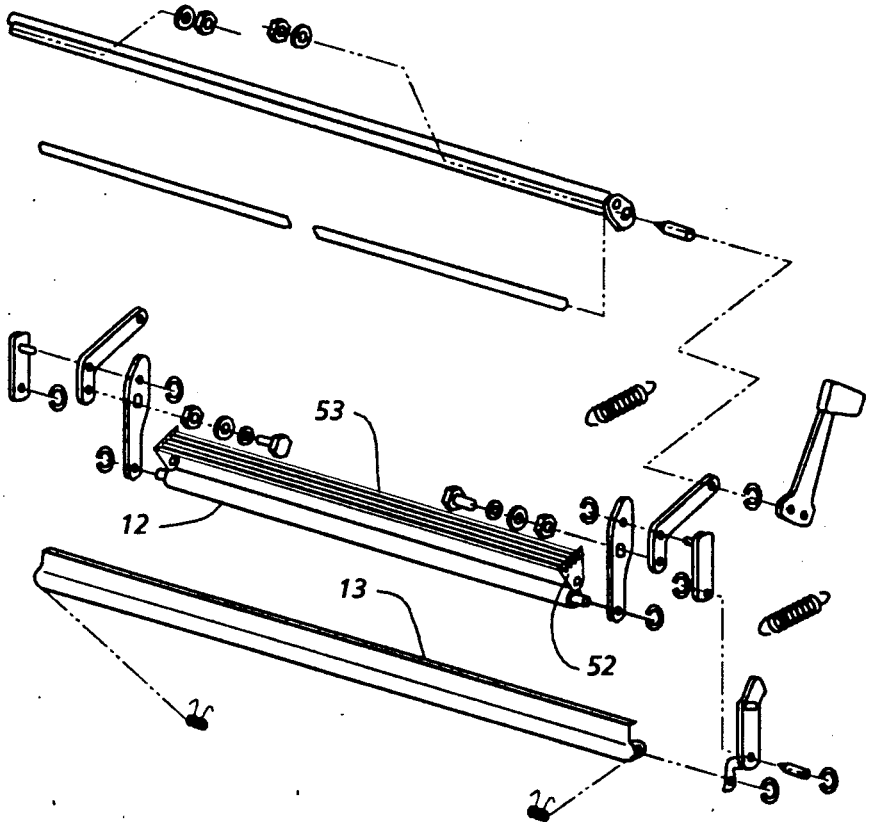
FIG. 6 depicts an alternative embodiment of a multi-element of a multi-ply paper separator.

FIG. 5 and FIG. 6 depict yet another embodiment wherein the separator elements 11 are disposed parallel to each other across the paper path and supported by two rigid brackets 51. The brackets 51 are attached to an inscribing machine by passing an axle of a roller 12 through holes 52 disposed in one end of each bracket or by fastening the brackets to a supporting element of the inscribing machine. The separating elements comprise a plurality of lengths of round wire 53 disposed parallel one to another in coincident holes 54 disposed in one end of each of the brackets. The ends of said wires are crimped to prevent slippage after being placed in the holes 54.

While a round wire is shown as the preferred embodiment it is also be possible to use wire of another shape or even a flat band to affect separation of the various webs. The device may be used with carbonless paper or carbon-leaved paper. The invention operates satisfactorily with any number of webs that are normally used in a particular inscribing machine. It is essential that the paper be pulled across the separator element rather than being pushed to prevent bunching of the paper and jamming of the paper feed path.

The present invention provides several novel features. No additional space is required for storage. It can easily be retrofitted to existing machines, is comparatively inexpensive to manufacture. It becomes an integral part of the inscribing machine, and eliminates manual separation of carbons during the decollating operation.

While various mechanical arrangements of the apparatus have been disclosed and described herein it is to be understood that there are mechanical arrangements of the apparatus that may be conceived that do not depart from the spirit of this invention, and that such mechanisms as fall within the scope of the appended claims are intended to be included herein.

Having thus fully described my invention what I claim as new and desired to be secured by letters patent is:

1. A separating apparatus attachable to a printer, typewriter, tabulator, or other inscribing device capable of processing a plurality of collectively interfolded webs of paper comprising:

a plurality of separator elements for separating individual leaves of collectively interfolded webs of paper, disposed such that the paper webs are drawn around said various separator elements comprise, a. two rigid flat support brackets attached to either end of a roller axle of an inscribing machine by passing said axle through a circular hole disposed in the first end of each of the said brackets, the first ends being rounded into semi-circular shapes, the second ends being flat with a plurality of coincident holes disposed parallel to the ends of the brackets; and b. a plurality of wires disposed parallel one to another through the holes in the flat ends of said brackets and secured in said holes by crimping the wire ends and a paper feed mechanism to pull the webs of paper into the inscribing device.

2. A separating apparatus attachable to a printer, typewriter, tabulator, or other inscribing device capable of processing a plurality of collectively interfolded webs of paper comprising:

a plurality of separator elements for separating individual leaves of collectively interfolded webs of paper, disposed such that the paper webs are drawn around said various separator elements and wherein said separator elements comprise lengths of wire shaped to form flat "U" shapes with the bottom of the "U"s being slightly longer than the width of the paper being separated, each leg of the element is bent to form a loop which fits around the axle of a roller on an inscribing device and a paper feed mechanism to pull the webs into the inscribing device.

3. A separating apparats attachable to a printer, typewriter, tabulator, or other inscribing device capable of processing a plurality of collectively interfolded webs of paper having marginally punched feed holes for a pin wheel feeding device comprising:

a plurality of separator elements for separating individual leaves of collectively interfolded webs of paper, disposed so that the paper webs are drawn around said various separator elements after passing the inscribing mechanism and wherein said separator elements comprise, a. two rigid flat support brackets attached to either end of a roller axle of an inscribing machine by passing said axle through a circular hole disposed in the first end of each of the said brackets, the first ends being rounded into semi-circular shapes, the second ends being flat with a plurality of coincident holes disposed parallel to the ends of the brackets; and b. a plurality of wires disposed parallel one to another through the holes in the flat ends of said brackets and secured in said holes by crimping the wire ends and a paper feed mechanism operatively positioned after the various separator elements.

4. A separating apparatus attachable to a printer, typewriter, tabulator, or other inscribing device capable of processing a plurality of collectively interfolded webs of paper having marginally punched feed holes for a pin wheel feeding device comprising:

a plurality of separator elements for separating individual leaves of collectively interfolded webs of paper, disposed so that the paper webs are drawn around said various separator elements after passing the inscribing mechanism and wherein said separator elements comprise, lengths of wire shaped to form flat "U" shapes with the bottom of the "U"s being slightly longer than the width of the paper being separated, each leg of the element is bent to form a loop which fits around the axle of a roller on an inscribing device and a paper feed mechanism operatively positioned after the various separator elements.

5. A separating apparatus attachable to a printer, typewriter, tabulator, or other inscribing device capable of processing a plurality of collectively interfolded webs of paper having marginally punched feed holes for a pin wheel feeding device comprising:

a plurality of separator elements for separating individual leaves of collectively interfolded webs of paper, disposed such that the paper webs are drawn around the various separator elements prior to passing the inscribing mechanism and wherein said separator elements comprise, a. two rigid flat support brackets attached to either end of a roller axle of an inscribing machine by passing said axle through a circular hole disposed in the first end of each of the said brackets, the first ends being rounded into semi-circular shapes, the second ends being flat with a plurality of coincident holes disposed parallel to the ends of the brackets; and b. a plurality of wires disposed parallel one to another through the holes in the flat ends of said brackets and secured in said holes by crimping the wire ends and a paper feed mechanism to pull the webs of paper into the inscribing device.

6. A separating apparatus attachable to a printer, typewriter, tabulator, or other inscribing device capable of processing a plurality of collectively interfolded webs of paper having marginally punched feed holes for a pin wheel feeding device comprising:

a plurality of separator elements for separating individual leaves of collectively interfolded webs of paper, disposed such that the paper webs are drawn around the various separator elements prior to passing the inscribing mechanism and wherein said separator elements comprise, lengths of wire shaped to form flat "U" shapes with the bottom of the "U"s being slightly longer than the width of the paper being separated, each leg of the element is bent to form a loop which fits around the axle of a roller on an inscribing device and a paper feed mechanism to pull the webs of paper into the inscribing device.

* * * * *